US006924813B2

(12) United States Patent
Selig et al.

(10) Patent No.: US 6,924,813 B2
(45) Date of Patent: Aug. 2, 2005

(54) TECHNIQUE FOR ELIMINATING STALE INFORMATION FROM A COMPUTER GRAPHICS BUFFER

(75) Inventors: Calvin Selig, Fort Collins, CO (US); Ethan W Gannett, Ft Collins, CO (US); Kendall F Tidwell, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 340 days.

(21) Appl. No.: 09/823,505

(22) Filed: Mar. 31, 2001

(65) Prior Publication Data

US 2002/0171654 A1 Nov. 21, 2002

(51) Int. Cl.[7] ..... G09G 5/37
(52) U.S. Cl. ..... 345/562; 345/531; 345/556
(58) Field of Search ..... 345/501–506, 345/519–520, 522, 530–574

(56) References Cited

U.S. PATENT DOCUMENTS 6,348,919 B1 * 2/2002 Murphy ..... 345/421

* cited by examiner

*Primary Examiner*—Kee M. Tung
(74) *Attorney, Agent, or Firm*—Kevin M. Hart

(57) ABSTRACT

A method of eliminating stale information from a computer graphics buffer. The method facilitates switching from a fast clear mode to a non fast clear mode during the lifetime of a region of interest such as a window: A clear count value associated with a pixel is read and compared with a current clear count. If the counts are not equal, a replacement value is written into the pixel. The process may be repeated for each pixel in the region. Block transfer hardware and fast clear hardware may be used together to perform the procedure in a high-performance manner: A source region and a destination region for the block transfer operation are both set to the region of interest. As the block transfer proceeds, each pixel is written either with its own value or with a replacement value depending on whether the clear count for the pixel is current.

30 Claims, 2 Drawing Sheets

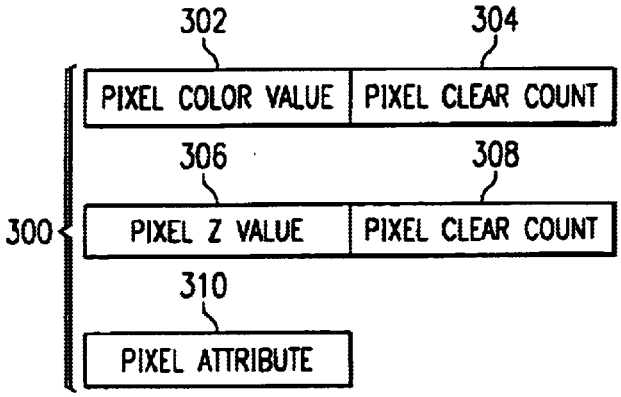
FIG. 3
FIG. 4
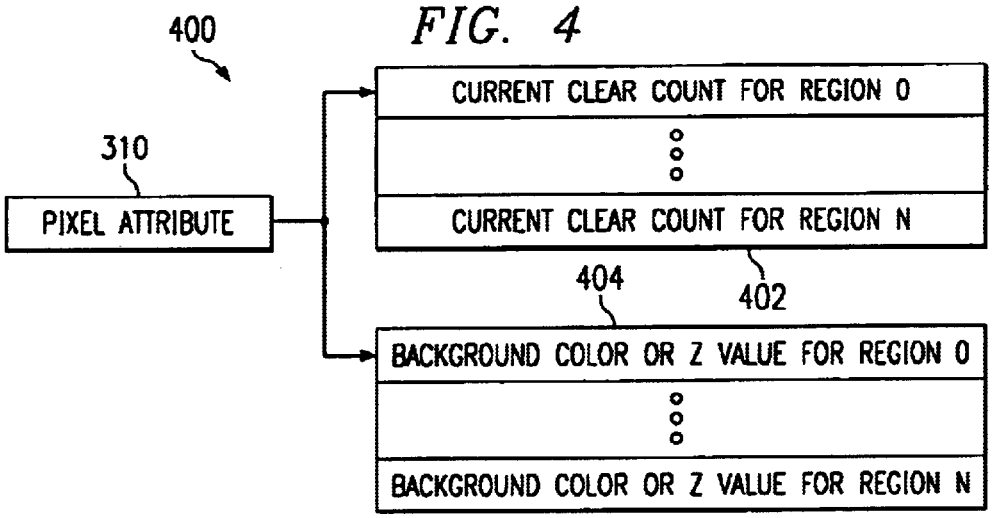
FIG. 5
(PRIOR ART)
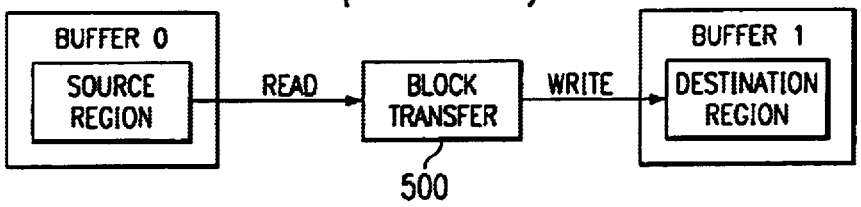
FIG. 6
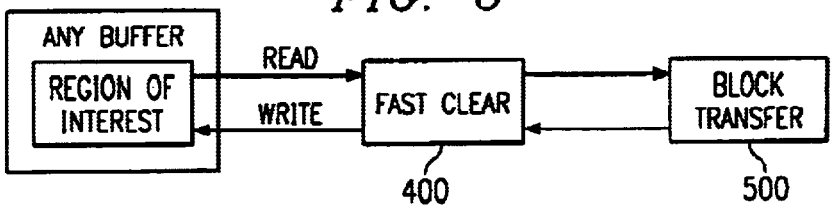

TECHNIQUE FOR ELIMINATING STALE INFORMATION FROM A COMPUTER GRAPHICS BUFFER

RELATED APPLICATIONS

This application is related to the following copending U.S. patent applications: "Fast Clear Technique for Display Regions Raving Subregions," filed Mar. 31, 2001 by Calvin Selig and Roy Troutman, assigned to Hewlett-Packard Company and having Ser. No. 09/823,483; and "Fast Clear Technique for Display Regions Raving Subregions, " filed Mar. 31, 2001 by Calvin Selig and Roy Troutman, assigned to Hewlett-Packard Company and having Ser. No. 09/823,660.

FIELD OF THE INVENTION

This invention relates generally to computer graphics, and more particularly to techniques for clearing and otherwise maintaining frame buffer memories in computer graphics systems.

BACKGROUND

In computer graphics, the operation of clearing a large area of frame buffer memory is very expensive in terms of both time and processing resources. For example, in a system having 1280×1024 resolution, clearing the frame buffer requires accessing more than one million pixels. Indeed, clearing such a large area of memory can require more time than it takes to draw a frame of an image after the clear has been completed. Designers have attempted to address this problem either by speeding up the process of clearing or by avoiding the process altogether.

Special-Purpose Memory Devices.

Frame buffers have been implemented using special-purpose memory devices that have a hardware clear feature. On one hand, the operation of clearing frame buffer memory in such embodiments is accelerated. On the other hand, the special-purpose memory devices used to implement the frame buffer add significantly to the cost of the implementation.

Fast Clear Techniques.

As an alternative to using expensive memory devices, it is possible to employ "fast clear" techniques to avoid writing data to a large number of pixel locations each time a clear command is issued by an application.

One such fast clear technique is taught in U.S. Pat. No. 5,851,447, issued to Michael D. Drews and assigned to Evans & Sutherland Computer Corporation (hereinafter "Drews"). Drews teaches allocating an additional field in frame buffer memory for each pixel and storing a version number in the additional field. An alternate pixel value (a clear value) and a current version number are maintained in a pixel processor. During frame buffer reads executed by the pixel processor, the version number corresponding to a pixel is read from the frame buffer first. If the version number read from the frame buffer is not equal to the current version number stored in the pixel processor, then the alternate pixel value stored in the pixel processor is substituted for the pixel value that would have been read from the frame buffer. On the other hand, if the version numbers are equal, then the pixel value is read from the frame buffer and used. According to this technique, multiple pixels in the frame buffer can be made to appear to have been modified simply by changing the current version number stored in the pixel processor. Thus, the frequency with which "real" clearing operations must be performed can be reduced.

Another fast clear technique is taught in U.S. patent application Ser. No. 09/283,336, filed by Jon Ashburn and Bryan Prouty on Mar. 31, 1999, titled "Improved Technique for Reducing the Frequency of Frame Buffer Clearing" (hereinafter "Ashburn"). Ashburn is hereby incorporated by reference in its entirety. Ashburn teaches apparatus and methods for operating in a fast clear mode without allocating additional fields per pixel beyond those already existing in a standard frame buffer memory. In addition, Ashburn teaches how the fast clear mode may be used in a windowed environment. The Ashburn fast clear mode may be used, for example, with inexpensive SDRAM frame buffer memory devices.

Stale Information and Ghost Images.

One aspect of operating according to the fast clear techniques of the prior art is that the contents of the frame buffer memory do not necessarily reflect what is actually being displayed on the monitor of the computer graphics system. This is because, for a pixel whose version number or frame count does not match the current version number or frame count, the pixel contents read from the frame buffer memory are replaced with a predetermined value before displaying the pixel on the monitor. (Hereinafter, the term "stale information" will be used to describe data stored in a frame buffer memory at a pixel location whose version or frame number does not match the current version number or frame count.) As long as the graphics system remains in a fast clear mode, stale information in the frame buffer does not cause problems. But if the mode of the graphics system changes from a fast clear mode to a non fast clear mode, "ghost images" will suddenly appear as a result of stale information being displayed on the monitor.

For this reason, it was heretofore believed impractical to switch from a fast clear mode to a non fast clear mode during the life of a display region such as a window. Instead, a decision was typically made before creating a new window whether the window would employ fast clear mode or not, and the mode of operation once chosen would not be changed during the life of the window. But the necessity of having a static clear mode during the life of a window is quite limiting: For fast clear windows, operations cannot be performed if they would require the frame buffer contents to match the image being displayed. And for non fast clear windows, the important performance enhancements provided by fast clear techniques are not realized.

It is therefore an object of the present invention to provide a practical technique for switching from a fast clear mode to a non fast clear mode during the life of a window or other region of interest.

SUMMARY OF THE INVENTION

In one aspect, the invention includes a method of eliminating stale information from a computer graphics buffer: A clear count value associated with a pixel location in the buffer (a pixel clear count) is read and compared with a current clear count. If the pixel clear count does not equal the current clear count, a predetermined pixel value (typically a color or z) is written into the pixel. The process may be repeated for each pixel location in a region of interest. For example, the region of interest may be a window. The technique may be used with image buffers, z buffers, or any other kind of buffer having data that correspond to pixel locations. When the technique is used with an image buffer, the new value would typically be a background color. The pixel clear count may be stored in the image or z buffer along with the pixel data or may be stored elsewhere and simply associated with the pixel data. The current clear count and the predetermined pixel value may be stored, for example, in a storage structure of a fast clear system.

In another aspect, the invention includes a method of eliminating stale information from a region of interest in a computer graphics buffer by performing a block transfer operation on pixel locations in the region of interest. A source region and a destination region for the block transfer operation are set to point to the same region (the region of interest). As the block transfer operation proceeds, at each pixel location a pixel clear count value associated with the pixel location is read and compared with a current clear count. If the pixel clear count does not equal the current clear count, a predetermined pixel value (typically a color or z) is written into the pixel location. In a preferred embodiment, block transfer hardware and fast clear hardware are used in combination to perform the operation. In such an embodiment, if the pixel clear count for a given pixel equals the current clear count, a color or z value read from the pixel location may be written back into the pixel location; and the pixel clear count value may be written back to the location from where it was read. For pixels being replaced by the predetermined color or z value, the pixel clear count corresponding to the pixel may be replaced with the current clear count. Alternatively, a new current clear count may be written into all pixel clear count fields corresponding to the region.

In still another aspect, the invention includes a method of eliminating stale information from a computer graphics buffer wherein an image is first rendered into the buffer while operating in a fast clear mode. A determination is made whether the fast clear mode remains appropriate given a current state of the computer graphics system. If the fast clear mode is no longer appropriate, then stale information resulting from operating in the fast clear mode is eliminated from a region of interest in the buffer prior to discontinuing fast clear mode. The clear mode for the region of interest may then be changed without causing ghost images to appear on the display.

BRIEF DESCRIPTION OF THE DRAWINGS

FIG. 3 is a block diagram illustrating example information that may be stored in association with a pixel in the buffers of FIG. 2.

FIG. 4 is a block diagram illustrating portions of a fast clear system that may be used in connection with the invention according to a preferred embodiment thereof.

FIG. 5 is a block diagram illustrating a prior art technique for using block transfer hardware in a computer graphics system.

FIG. 6 is a block diagram illustrating a technique for using block transfer hardware and fast clear hardware according to a preferred embodiment of the invention.

DETAILED DESCRIPTION OF THE PREFERRED EMBODIMENTS

Switching Clear Modes During the Life of a Display Region.

Figure 1:
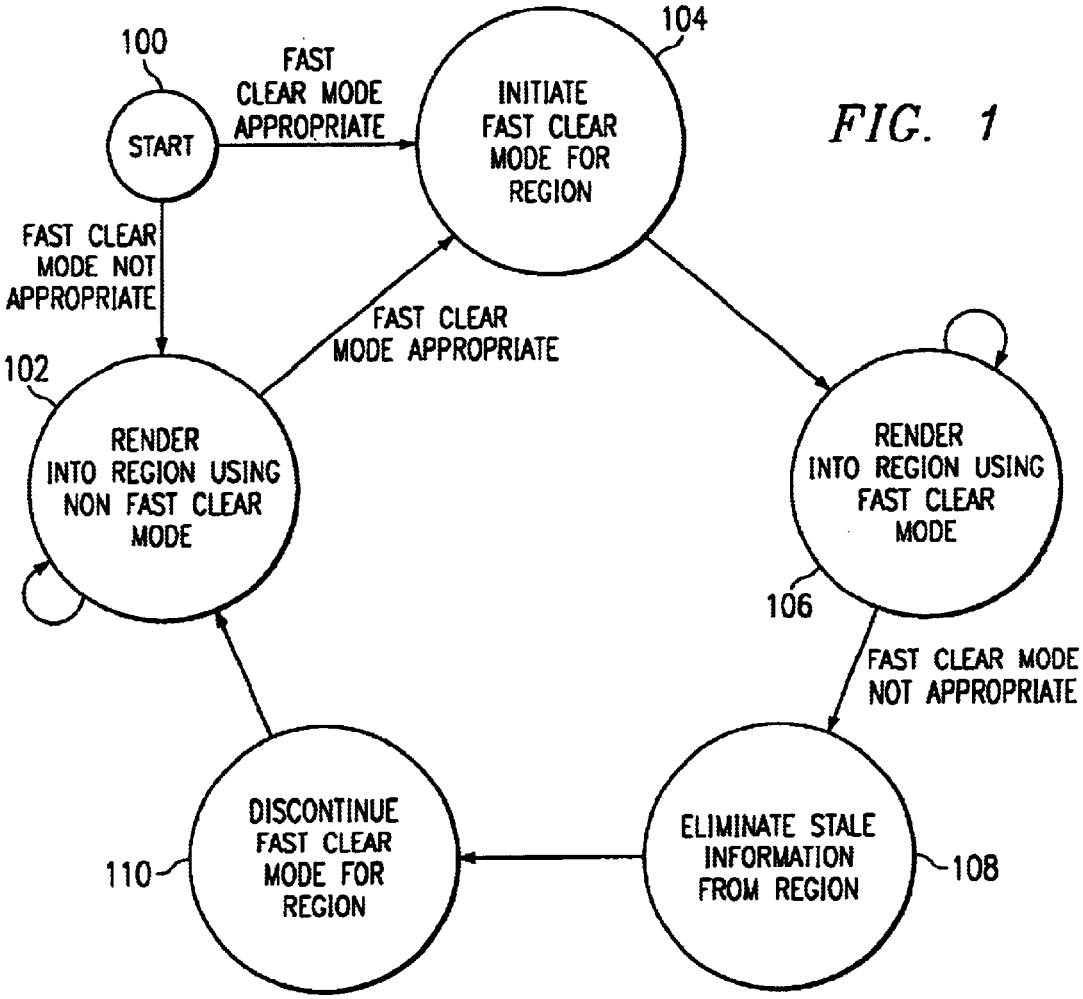
FIG. 1 is a state diagram illustrating a technique for switching from a fast clear mode to a non fast clear mode during the life of a display region by eliminating stale information from a graphics buffer according to a preferred embodiment of the invention.

FIG. 1 is a state diagram illustrating a technique for switching from a fast clear mode to a non fast clear mode during the life of a display region by eliminating stale information from a graphics buffer according to a preferred embodiment of the invention. Start state 100 may represent a time before, during or just after creation of a region of interest in the graphics buffer. The region of interest may be, for example, a window, subwindow or viewport. Throughout this document, use of any one of these specific terms during an explanation is meant to include the other terms also, as well as any term that could be used to describe a region of interest in a graphics buffer.

A determination may be made before or during start state 100 whether or not operation in a fast clear mode would be appropriate given the current state of the computer graphics system including the characteristics of the region of interest. For example, attribute bits corresponding to a window are typically used to identify a current clear count register in a fast clear system for use in fast clearing that window. In some circumstances, windows are forced to share an attribute number with other windows. Typically, such a circumstance would indicate that operation in fast clear mode would not be appropriate for the window, and rendering would begin in state 102 in a non fast clear mode. On the other hand, if the window has a unique attribute number or some other means is available to uniquely identify fast clear registers for the window, then operation in a fast clear mode would be appropriate, and the next state would be state 104.

In state 104, a predetermined value may be stored in a fast clear register corresponding to the region of interest. In the case of rendering to an image buffer, the predetermined value would typically be a color value—specifically, a background color value. An initial clear count for the region may be stored in a current clear count register corresponding to the region of interest. Alternatively, the clear count already resident in that register may be used.

In state 106, the graphics system may render into the region using the fast clear mode. The system may remain in state 106 indefinitely. It may happen, however, that circumstances change during the life of the region being rendered into. For example, window systems such as the well-known X Window System occasionally change the attribute assignment of an existing window in order to accommodate the creation of one or more new windows. Such a change in attribute assignments can mean that a window previously having a unique attribute assignment will now have to share an attribute number with one or more other windows. This would be one example of numerous circumstances in which fast clear mode would no longer be appropriate for a region of interest. Upon detecting such an occurrence, the system would transition to state 108, in which stale information is eliminated from the region. (Preferred techniques for eliminating stale information from the region will be discussed in further detail below.) In state 110, system settings may be modified so that fast clear mode is discontinued for the region. Rendering may then resume in state 102 using a non fast clear mode of operation. Whenever it becomes appropriate once again to resume fast clear mode for the region, the system may transition to state 104 from state 102.

Eliminating Stale Information from a Region.

Table 1 below is a pseudocode representation of a preferred technique for eliminating stale information from a region of a graphics buffer.

TABLE 1

```
eliminateStaleInformationFromBufferRegion ( regionPtr )
{
  for ( each pixel in region )
{
    read pixelClearCount;
    optionally read pixelColorValue or pixelZValue;
    if ( pixelClearCount not equal to currentClearCount )
    {
        write predetermined color or z value into pixel;
        optionally write currentClearCount into pixelClearCount;
    }
    else
    {
        optionally write pixel color or z value back into pixel;
        optionally write pixelClearCount back into pixelClearCount;
    }
  }
}
```

As the pseudocode indicates, the following occurs for each pixel in the region: The clear count value associated with the pixel is read and compared with the current clear count for the region. (The clear count value associated with the pixel may be stored in one of the bit fields at the pixel's color or z value address. It may also be stored elsewhere in memory and merely associated with the pixel's color or z value address.) If the clear count value associated with the pixel is not equal to the current clear count for the region, then a predetermined value is written into the pixel color or z value.

Optionally the procedure may be designed so that every pixel value is read and written regardless of whether the pixel's clear count is current. In such an embodiment, the pixel value read will be written back into the pixel if the pixel clear count is current. But if the pixel clear count is not current, then the predetermined value is written back into the pixel in lieu of the pixel's previous value. In either embodiment, the current clear count for the region (or an alternative clear count value) may be written into the pixel's clear count in lieu of the pixel's previous clear count.

Example Host System.

Figure 2:
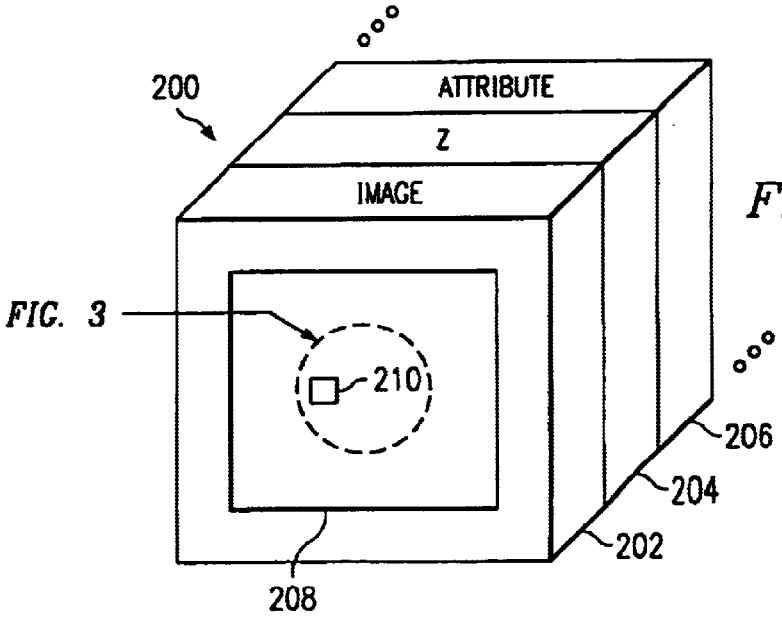
FIG. 2 is a block diagram illustrating a set of graphics buffers in an example host computer graphics system in which the invention may be employed.

FIGS. 2–4 illustrate portions of an example host computer graphics system in which aspects of the invention may be employed. Graphics buffer 200 may include numerous "planes" or buffers such as image buffer 202, z buffer 204 and attribute plane 206. Typically, a region of interest 208 would include numerous pixels 210. Depending on which buffer or plane is being accessed, the information 300 stored in association with a given pixel might include that shown in FIG. 3. In the image buffer, a pixel storage location might include a pixel color value 302 and a pixel clear count 304. In the z buffer, a pixel storage location might include a pixel z or depth value 306 and a pixel clear count 308. (Alternatively, pixel clear counts 304 and 308 may be stored elsewhere and associated with corresponding pixels.) In the attribute plane, one attribute number 310 might be stored for each pixel.

The host system would also typically include a fast clear system 400 similar to the ones taught by Ashburn or Drews (see above). Such a fast clear system may use the pixel attribute number 310 to select a current clear count and a predetermined color or z value for a region of interest. The current clear counts and predetermined color or z values may be stored in fast clear storage structures 402, 404, respectively. Storage structures 402, 404 may take any suitable form such as, for example, registers or lookup tables. Optimally, a fast clear system 400 for use with the invention should have the capability to replace a color or z value with a predetermined value not only in the read path but also in the write path. Fast clear system 400 will have corresponding components in the display controller system as well as in the frame buffer controller system; the nature of such components will be apparent to those having ordinary skill in the art and having reference, for example, to Ashburn.

Use of Block Transfer Hardware and Fast Clear Hardware for High Performance Elimination of Stale Information from a Graphics Buffer.

FIG. 5 illustrates a prior art method in which well-known block transfer (BLT or "blit") hardware 500 may be used to transfer pixel information from a source region in a first buffer (buffer 0) to a destination region in a second buffer (buffer 1) in a high-performance manner. Such block transfer hardware 500 is commonly used, for example, to transfer pixel information from a back (non-visible) buffer to a front (visible) buffer.

The inventors hereof have discovered that block transfer hardware 500 may be used in conjunction with fast clear hardware 400 to eliminate stale information from a graphics buffer in a high-performance manner, as illustrated in FIG. 6. In the technique of FIG. 6, the source region and the destination region for the block transfer operation are set to the same region (the region of interest). For each pixel location in the region, the pixel clear count is read and compared with a current clear count for the region. If the pixel clear count is not equal to the current clear count for the region, a predetermined value (such as a background color or default z value) is written back into the pixel.

Typically during a block transfer operation, every pixel in the source region is read, and every pixel in the destination region is written. Therefore, particularly beneficial results may be obtained in implementations wherein the pixel clear count is stored in one of the bit fields at the pixel's address (see FIG. 3). In such implementations, block transfer hardware and fast clear hardware may be used together to read both the pixel value and pixel clear count in one operation. If the pixel clear count is current, the pixel value and the pixel clear count may simply be written back into the pixel. But if the pixel clear count is not current, the predetermined pixel value may be written into the pixel. Either the current clear count for the region or some alternative count value may be written into the pixel clear count bit field.

Conclusion.

While the invention has been described in detail with reference to preferred embodiments thereof, the described embodiments have been presented by way of example and not by way of limitation. For example, the techniques described may be applied to any type of graphics buffer. Moreover, the techniques may be implemented in hardware, software, or in a hybrid hardware/software manner. In one embodiment, the invention was implemented with driver software in conjunction with the hardware described above.

What is claimed is:

1. A method of eliminating stale information from a computer graphics buffer, comprising:

reading a clear count value associated with a pixel location in the buffer;

comparing the clear count value with a current clear count; and if the clear count value does not equal the current clear count, writing a predetermined value to the pixel location in the buffer;

wherein the step are performed for each of the pixels defining a region of interest in the buffer, and are performed using a block transfer operation wherein a source region. and a destination region both correspond to the region of interest.

2. The method of claim 1, wherein;

all of the pixels in the region of interest are read and written during the block transfer operation; and for a given pixel, if the clear count value equals the current clear count, a stored value read from the pixel location is written back to the pixel location.

3. A method of eliminating stale information from a computer graphics buffer, comprising:

performing a block transfer operation on pixel locations of the buffer;

wherein a source region and a destination region for the block transfer operation are the same; and wherein, for each pixel location, the block transfer operation comprises: reading a clear count value associated with the pixel location;

comparing the clear count value with a current clear count; and if the clear count value does not equal the current clear count, writing a predetermined value to the pixel location.

4. The method of claim 3, further comprising:

if the clear count value equals the current clear count, writing a stored value read from the pixel location back to the pixel location.

5. The method of claim 3, where:

the clear count value is read from the pixel location in the buffer.

6. The method of claim 3, wherein:

the predetermined value and the current clear count are stored in storage structures of a fast clear system.

7. The method of claim 3, wherein:

the writing step comprises replacing the clear count value with the current clear count.

8. A method of eliminating stale information from a buffer of computer graphics system, comprising:

using a fast clear mode, rendering in a region of interest within the buffer;

determining, responsive to a state of the computer graphics system, that the fast clear mode should be discontinued; and for each pixel location in the region of interest: reading a clear count value associated with the pixel location;

comparing the clear count value with a current clear count; and if the clear count value does not equal the current clear count, writing a predetermined value to the pixel location.

9. The method of claim 8, wherein the region of interest is a window.

10. The method of claim 8, further comprising:

determining, responsive to a state of the computer graphics system, that the fast clear mode may be resumed; and resuming operation in the fast clear mode.

11. The method of claim 8, wherein:

the clear count value is read from the pixel location in the buffer.

12. The method of claim 8, wherein:

the predetermined value represents a background color.

13. The method of claim 8, wherein:

the predetermined value and the current clear count are stored in storage structures of a fast clear system.

14. The method of claim 8, wherein:

the reading a writing steps are performed using a block transfer operation wherein a source region and a destination region of the block transfer operation both correspond to the region of interest.

15. The method of claim 14, wherein:

all of the pixels in the region of interest are read and written during the block transfer operation; and for a given pixel, if the clear count value equals the current clear count, a stored value read from the pixel location is written back to the pixel location.

16. The method of claim 8, further comprising:

reading a stored value from the pixel location; and if the clear count value equals the current clear count, writing the stored value back to the pixel location.

17. The method of claim 8, wherein:

the writing step comprises replacing the clear count value with the current clear count.

18. Computer program code embodied in a machine-readable storage or transmission medium which, when executed on a computer, causes the computer to perform a method of eliminating stale information from a computer graphics buffer, comprising:

reading a clear count value associated with a pixel location in the buffer;

comparing the clear count value with a current clear count; and if the clear count value does not equal the current clear count, writing a predetermined value to the pixel location in the buffer; wherein the steps are performed for each of the pixels defining a region of interest in the buffer, and are performed using a block transfer operation wherein a source region and a destination region both correspond to the region of interest.

19. The computer program code of claim 18, wherein:

all of the pixels in the region of interests are read and written during the block transfer operation; and for a given pixel, if the clear count value equals the current clear count, a stored value read from the pixel location is written back to the pixel location.

20. Computer program code embodied in a machine-readable storage or transmission medium which, when executed on a computer, cause the computer to perform a method of eliminating stale information from a computer graphics buffer, comprising:

performing a block transfer operation on pixel locations of the buffer;

wherein a source region and a destination region for the block transfer operation are the same; and wherein, for each pixel location, the block transfer operation comprises:

reading a clear count value associated with the pixel location; comparing the clear count value with a current clear count; and if the clear count value does not equal the current clear count, writing a predetermined value to the pixel location.

21. The computer program code of claim 20, further comprising:

if the clear count value equals the current clear count, writing a stored value read from the pixel location back to the pixel location.

22. The computer program code of claim 20, wherein:

the clear count value is read from the pixel location in the buffer.

23. The computer program code of claim 20, wherein:

the predetermined value and the current clear count are stored in storage structures of a fast clear system.

24. The computer program code of claim 20, wherein:

the writing step comprises replacing the clear count value with the current clear count.

25. Computer program code embodied in a machine-readable storage or transmission medium which, when executed on a computer, causes the computer to perform a method of eliminating stale information from a buffer of a computer graphics system, comprising:

using a fast clear mode, rendering an image in a region of interest within the buffer;

determining, responsive to a state of the computer graphics system, that the fast clear mode should be discontinued; and for each pixel location in the region of interest: reading a clear count value associated with the pixel location; comparing the clear count value with a current clear count; and if the clear count value does not equal the current clear count, writing a predetermined value to the pixel location.

26. The computer program code of claim 25, wherein the region of interest is a window.

27. The computer program code of claim 25, further comprising:

determining, responsive to a state of the computer graphics system, that the fast clear mode may be resumed; and resuming operation in the fast clear mode.

28. The computer program code of claim 25, wherein:

the reading a writing steps are performed using a block transfer operation wherein a source region and a destination region of the block transfer operation both correspond to the region of interest.

29. The computer program code of claim 28, wherein all of the pixels in the region of interest are read and written during the block transfer operation; and for a given pixel, if the clear count value equals the current clear count, a stored value read from the pixel location is written back to the pixel location.

30. The computer program code of claim 25, wherein:

the writing step comprises replacing the clear count value with the current clear count.

* * * * *